US007396804B2

(12) United States Patent
Farooq et al.

(10) Patent No.: US 7,396,804 B2
(45) **Date of Patent: *Jul. 8, 2008**

(54) OIL CONTAINING STARCH GRANULES FOR DELIVERING BENEFIT-ADDITIVES TO A SUBSTRATE

(75) Inventors: Amjad Farooq, Hillsborough, NJ (US); Riad A. Taha, Spotswood, NJ (US); Sayed Ibrahim, Somerset, NJ (US); Patrick J. Getty, Metuchen, NJ (US); Eugene E. Pashkovski, Bridgewater, NJ (US); Natasha Dwight, Plainfield, NJ (US); Daniel W. Smith, Belvidere, NJ (US); Jeffrey Mastrull, Bridgewater, NJ (US); Cynthia J. Mussinan, Howell, NJ (US); Lewis Michael Popplewell, Morganville, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/746,914

(22) Filed: May 10, 2007

(65) Prior Publication Data

US 2007/0287656 A1 Dec. 13, 2007

Related U.S. Application Data

(62) Division of application No. 10/803,586, filed on Mar. 18, 2004, now Pat. No. 7,279,454.

(51) Int. Cl.
*C11D 3/37* (2006.01)
*C11D 3/50* (2006.01)

(52) U.S. Cl. ..... 510/101; 510/438; 510/474

(58) Field of Classification Search ..... 510/101, 510/438, 474
See application file for complete search history.

(56) References Cited

U.S. PATENT DOCUMENTS

| | | | | |
|---|---|---|---|---|
| 3,114,603 | A | 12/1963 | Howell | |
| 5,858,959 | A | 1/1999 | Surutzidis et al. | |
| 6,608,017 | B1 * | 8/2003 | Dihora et al. | 510/349 |
| 7,098,017 | B2 * | 8/2006 | von der Osten et al. | 435/220 |
| 7,276,472 | B2 * | 10/2007 | Farooq et al. | 510/442 |
| 7,279,454 | B2 * | 10/2007 | Farooq et al. | 510/474 |
| 2003/0045447 | A1 | 3/2003 | Heibel et al. | |
| 2003/0203829 | A1 | 10/2003 | Shefer et al. | |
| 2004/0023838 | A1 | 2/2004 | Schramm et al. | |
| 2005/0250670 | A1 | 11/2005 | Caswell et al. | |

FOREIGN PATENT DOCUMENTS

| | | |
|---|---|---|
| EP | 0539025 B1 | 12/1998 |
| WO | WO 99/55819 | 11/1999 |
| WO | WO 01/05926 | 1/2001 |
| WO | WO 01/25389 | 4/2001 |
| WO | WO 01/40430 | 6/2001 |

OTHER PUBLICATIONS http://www.cermav.cnrs.fr/glyco3d/lessons/starch/page.php.50.html, no date available.*

* cited by examiner

*Primary Examiner*—John R Hardee
(74) *Attorney, Agent, or Firm*—Ellen K. Park

(57) ABSTRACT

An oil containing starch granule is provided comprising:
(a) a starch to form an effective matrix for said granule;
(b) a perfume oil comprising ingredients having a calculated Clog P of at least 3; and
(c) an effective amount of an organic compound as herein described for inhibiting the migration of said oil to the surface of said starch granule.

4 Claims, No Drawings

OIL CONTAINING STARCH GRANULES FOR DELIVERING BENEFIT-ADDITIVES TO A SUBSTRATE

CROSS REFERENCE TO RELATED APPLICATIONS

This application is a divisional application of Ser. No. 10/803,586, filed on 18 Mar. 2004, now U.S. Pat. No. 7,279,454, which is incorporated herein by reference.

BACKGROUND OF THE INVENTION

The addition of perfume to a liquid detergent composition to impart a pleasing aroma or fragrance to such detergent composition is well-known in the art. The presence of perfume provides an aesthetic benefit to the consumer upon use of the detergent composition and generally serves as a signal of freshness and cleanliness for laundered fabrics which contain a pleasing fragrance. However, notwithstanding the enhanced aroma of the detergent composition itself, relatively little of the perfume fragrance is imparted to fabrics during laundering. Primarily, this is because the perfume ingredients in the liquid composition are rapidly dispersed and diluted during laundering in the aqueous wash and rinse waters. Consequently, only a relatively limited amount of the perfume is available to contact the fabrics during washing, the major portion of the perfume being drained from the washing machine with the wash solution. There remains, therefore, a need in the art to improve the effectiveness of delivering perfume from a detergent composition to washed fabrics and to enhance the longevity of such fragrance on the fabrics.

Similarly, there is a need in the art to effectively deliver oils other than a perfume fragrance as benefit-additives to substrates such as hard surfaces, hair and skin such that the longevity of such oils upon the substrate is significantly enhanced relative to conventional means of providing such benefit additive to the substrate.

SUMMARY OF THE INVENTION

The present invention provides an oil containing starch granule comprising (a) a starch, said starch being present in an amount to form an effective matrix for said granule;

(b) a perfume oil comprising ingredients having a calculated Clog P of at least 3, said Clog P being the calculated octanol to water partition coefficient, said perfume oil being capable of providing a benefit-additive to a substrate upon contact therewith, said substrate being selected from the group consisting of fabrics, hard surfaces, hair and skin; and (c) an effective amount of an organic compound for inhibiting the migration of said oil to the surface of said starch granule, said compound being represented by the following structure:

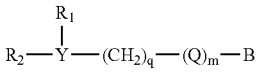

(1)

wherein $R_1$ and $R_2$ are each independently, H or:

(a) $C_1$-$C_{22}$ alkylenecarboxy moiety having the formula $$—(CH_2)_eR_3$$

wherein $R_3$ is —$NHCOR_4$; or —$OCOR_4$; or —$NR_5COR_4$; and wherein $R_4$ and $R_5$ are each independently $C_1$-$C_{22}$ alkyl or alkenyl; and e is an integer from 1 to 22; or (b) $C_1$-$C_{22}$ linear or branched alkyl; or (c) $C_1$-$C_{22}$ linear or branched alkenyl; or (d) $C_2$-$C_{22}$ substituted or unsubstituted alkylenoxy; or (e) $C_3$-$C_{22}$ substituted or unsubstituted alkylenoxy alkyl; or (f) $C_6$-$C_{22}$ substituted or unsubstituted aryloxy; or (g) $C_7$-$C_{22}$ substituted or unsubstituted alkylenearyl; or (h) $C_7$-$C_{22}$ substituted or unsubstituted alkyleneoxyaryl; or (i) $C_7$-$C_{22}$ oxyalkylenearyl; or (j) an anionic unit having the formula:

$$—(CH_2)_yR_6$$

wherein $R_6$ is —$SO_3M$, —$OSO_3M$, —$PO_3M$, —$OPO_3M$. Cl or mixtures thereof, wherein M is hydrogen, or one or more salt forming cations sufficient to satisfy charge balance, or mixtures thereof;

y is an integer from 1 to about 22; or (k) a mixture comprising at least two of (a) through (j); and q is an integer from 0 to about 22;

m is an integer from 0 to about 22;

Q is $(CH_2)_m$ or $(CH_2CHR_7O)$;

$R_7$ is independently hydrogen, methyl, ethyl, propyl or benzyl;

B is H or OH; and

Y is $CR_1$ or N.

In alternate embodiments of the invention, the compound which is used for inhibiting the migration of said oil to the surface of the starch granule is represented by a difatty amido amine compound to formula (2) or a quaternary ammonium compound corresponding to formula (3) as follows:

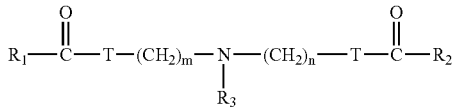

(2)

wherein $R_1$ and $R_2$, independently, represent $C_{12}$ to $C_{30}$ aliphatic hydrocarbon groups, $R_3$ represents $(CH_2CH_2O)_pH$, $CH_3$ or H; T represents NH; n is an integer from 1 to 5; m is an integer from 1 to 5 and p is an integer from 1 to 10.

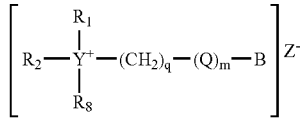

(3)

wherein $R_1$ and $R_2$ are each independently, H or:

(a) $C_1$-$C_{22}$ alkylenecarboxy moiety having the formula:

$$—(CH_2)_eR_3$$

wherein $R_3$ is —$NHCOR_4$; or —$OCOR_4$; or —$NR_5COR_4$; and wherein $R_4$ and $R_5$ are each independently $C_1$-$C_{22}$ akyl or alkenyl; and e is an integer from 1 to 22; or (b) $C_1$-$C_{22}$ linear or branched alkyl; or (c) $C_1$-$C_{22}$ linear or branched alkenyl; or (d) $C_2$-$C_{22}$ substituted or unsubstituted alkylenoxy; or
(e) $C_3$-$C_{22}$ substituted or unsubstituted alkylenoxy alkyl; or
(f) $C_6$-$C_{22}$ substituted or unsubstituted aryloxy; or
(g) $C_7$-$C_{22}$ substituted or unsubstituted alkylenearyl; or
(h) $C_7$-$C_{22}$ substituted or unsubstituted alkyleneoxyaryl; or
(i) $C_7$-$C_{22}$ oxyalkylenearyl; or
(j) an anionic unit having the formula:

$$—(CH_2)_yR_6$$

wherein $R_6$ is $—SO_3M$, $—OSO_3M$, $—PO_3M$, $—OPO_3M$, Cl or mixtures thereof,
wherein M is hydrogen, or one or more salt forming cations sufficient to satisfy charge balance, or mixtures thereof;
y is an integer from 1 to about 22; and
(k) a mixture comprising at least two of (a) through (j); and
q is an integer from 0 to about 22;
m is an integer from 0 to about 22;
Q is $(CH_2)_m$ or $(CH_2CHR_7O)$;
$R_7$ is independently hydrogen, methyl, ethyl, propyl or benzyl; and mixtures thereof;
B is H or OH;
Y is N;
$R_8$ is H or $C_1$-$C_4$ alkyl;
$Z^-$ is a counter anion, and preferably chloride, or methyl sulfate.

In accordance with the method aspect of the invention there is provided a method of laundering fabrics comprising the step of contacting such fabrics with an aqueous solution containing an effective amount of an oil containing starch granule of the invention.

The is also provided a method of preparing an oil containing starch granule comprising the steps of
(a) providing a dispersion of starch in water to form a starch slurry;
(b) melting an effective amount of an organic compound such as an amido amine comprising bis (alkyl amidoethyl)-2-polyethoxy amine to form an amidoamine melt;
(c) adding a fragrance oil to the organic compound melt or amidoamine melt of step (b) to form a solution of organic compound or of amidoamine in fragrance oil, said fragrance oil comprising ingredients having a calculated Clog P of at least 3, said Clog P being the calculated octanol to water partition coefficient;
(d) adding the solution of step (c) to the starch slurry of step (a);
(e) homogenizing the resultant slurry by mixing to form a uniform homogeneous mixture; and
(f) spray-drying said homogeneous mixture to form an oil containing starch granule.

The oils useful for the present invention can be any oil that is a liquid between about 10° C. and 90° C. and is capable of providing a benefit-additive to fabrics, hard surfaces, hair or skin. For laundry applications the preferred oils are perfumes, the term "perfume" being used herein to refer to odoriferous materials which are able to provide a pleasing fragrance to fabrics, and encompasses conventional materials commonly used in detergent compositions to counteract a malodor in such compositions and/or provide a pleasing fragrance thereto. The perfumes are preferably in the liquid state at ambient temperature, although solid perfumes are also useful.

The perfume oil of the invention comprises ingredients having a Clog P of at least 3 wherein Clog P is the calculated octanol to water partition coefficient. Clog P is a parameter indicating water solubility or hydrophobicity of the perfume. The higher the value of Clog P, the more hydrophobic the perfume. An increase in the partition coefficient affords higher substantivity (a long lasting odor, slowly emitted from the laundered fabric; Sina D. Escher and Esther Oliveros; A Quantitative Study of Factors That Influence the Substantivity of Fragrance Chemicals on Laundered and Dried Fabrics; Journal of American Oil Chemist's Society Volume 71, No. 1, pages 31-40, 1994). A perfume with Clog P value of 3 or higher is more effectively deposited onto the fabric surface (from a laundry product) than from a perfume with a value below 3. Thus the perfume ingredients of this invention have Clog P of about 3 or higher, preferably more than about 3.2 and even more preferably more than about 3.3.

The ClogP of many perfume ingredients has been reported, for example, the Ponoma92 database, available from Daylight Chemical Information Systems, Inc. (Daylight CIS) Irvine, Calif. The values are most conveniently calculated using ClogP program also available from Daylight CIS. The program also lists experimentally determined logP values when available from the Pomona database. The calculated logP (ClogP) is normally determined by the fragment approach on Hansch and Leo (A. Leo, in Comprehensive Medicinal Chemistry, Vol. 4, C. Hansch, P. G. Sammens, J. B. Taylor and C. A. Ransden, Editors, p. 295 Pergamon Press, 1990). This approach is based upon the chemical structure of the fragrance ingredient and takes into account the numbers and types of atoms, the atom connectivity and chemical bonding. The ClogP values which are most reliable and widely used estimates for this physiochemical property can be used instead of the experimental LogP values useful in the present invention. Further information regarding ClogP and logP values can be found in U.S. Pat. No. 5,500,138.

Included among the perfumes contemplated for use herein are materials such as aldehydes, ketones, esters and the like which are conventionally employed to impart a pleasing fragrance to liquid and granular deterrent compositions. Naturally occurring plant and animal oils are also commonly used as components of perfumes. Accordingly, the perfumes useful for the present invention may have relatively simple compositions or may comprise complex mixtures of natural and synthetic chemical components, all of which are intended to provide a pleasant odor or fragrance when applied to fabrics. The perfumes used in detergent compositions are generally selected to meet normal requirements of odor, stability, price and commercial availability. The term "fragrance" is often used herein to signify a perfume itself, rather than the aroma imparted by such perfume.

Other oils which may be useful herein for providing a benefit-additive to one or more of the aforementioned substrates of fabrics, hard surfaces, hair and skin include vitamins such as vitamin E (Tocopheryl esters), modified and unmodified silicone oils, surfactants, fabric softeners, fatty alcohols, fatty acids, fatty esters, etc. These oils can be employed as such or a combination of any of the oils mentioned can be used.

DETAILED DESCRIPTION OF THE INVENTION

The starches which are suitable for the starch granule of the present invention can be made from raw starch or a modified starch derived from tubers, legumes, cereal and grains, for example corn starch, wheat starch, rice starch, waxy corn starch, oat starch, cassava starch, waxy barley, waxy rice starch, sweet rice starch, amoica, potato starch, tapioca starch, oat starch, cassava starch, and mixtures thereof.

Modified starches suitable for use include, hydrolyzed starch, acid thinned starch, starch esters of long chain hydrocarbons, starch acetates, starch octenyl succinate, and mixtures thereof.

The term "hydrolyzed starch" refers to oligosaccharide-type materials such as cornstarch, maltodextrins and corn syrup solids.

The organic compound used for inhibiting migration of the oil to the granule surface is preferably an amidoamine having the following formula:

$$R_1—CONH(CH_2)_nNR_2R_3 \quad (I)$$

wherein $R_1$=$C_{12}$ to $C_{30}$ alkyl or alkenyl,
$R_2$=$R_1CONH(CH_2)_m$,
$R_3$=$(CH_2CH_2O)_pH$, $CH_3$ or H,
n=1 to 5,
m=1 to 5, and
p=1 to 10.

In a more preferred softening compound of formula (I),
$R_1$=$C_{16}$ to $C_{22}$ alkyl,
n=1 to 3,
m=1 to 3, and
p=1.5 to 3.5.

In the above formulas, $R_1$ and $R_2$ are each, independently, long chain alkyl or alkenyl groups having from 12 to 30 carbon atoms, preferably from 16 to 22 carbon atoms, such as, for example, dodecyl, dodecenyl, octadecyl, octadecenyl. Typically, $R_1$ and $R_2$ will be derived from natural oils containing fatty acids or fatty acid mixtures, such as coconut oil, palm oil, tallow, rape oil and fish oil. chemically synthesized fatty acids are also usable. The saturated fatty acids or fatty acid mixtures, and especially hydrogenated tallow (H-tallow) acid (also referred to as hard tallow), are preferred. Generally and preferably $R_1$ and $R_2$ are derived from the same fatty acid or fatty acid mixture.

$R_3$ represents $(CH_2CH_2O)pH$, $CH_3$ or H, or mixtures thereof may also be present. When $R_3$ represents the preferred $(CH_2CH_2O)pH$ group, p is a positive number representing the average degree of ethoxylation, and is preferably from 1 to 10, especially 1.5 to 6, and most preferably from about 2 to 4, such as 2.5, n and m are each integers of from 1 to 5, preferably 2 to 4, especially 2. The compounds of formula (I) in which $R_3$ represents the preferred $(CH_2CH_2O)pH$ group are broadly referred to herein as ethoxylated amidoamines, and the term "hydroxyethyl" is also used to describe the $(CH_2CH_2O)pH$ group.

The laundry detergent compositions of the invention may contain one or a mixture of surfactants from the group consisting of anionic, nonionic and cationic surfactants.

Any suitable nonionic detergent compound may be used as a surfactant in the present laundry detergent compositions, with many members thereof being described in the various annual issues of *Detergents and Emulsifiers*, by John W. McCutcheon. Such volumes give chemical formulas and trade names for commercial nonionic detergents marketed in the United States, and substantially all of such detergents can be employed in the present compositions. However, it is highly preferred that such nonionic detergent be a condensation product of ethylene oxide and higher fatty alcohol (although instead of the higher fatty alcohol, higher fatty acids and alkyl [octyl, nonyl and isooctyl] phenols may also be employed). The higher fatty moieties, such as the alkyls, of such alcohols and resulting condensation products, will normally be linear, of 10 to 18 carbon atoms, preferably of 10 to 16 carbon atoms, more preferably of 12 to 15 carbon atoms and sometimes most preferably of 12 to 14 carbon atoms. Because such fatty alcohols are normally available commercially only as mixtures, the numbers of carbon atoms given are necessarily averages but in some instances the ranges of numbers of carbon atoms may be actual limits for the alcohols employed and for the corresponding alkyls.

The ethylene oxide (EtO) contents of the nonionic detergents will normally be in the range of 3 to 15 moles of EtO per mole of higher fatty alcohol, although as much as 20 moles of EtO may be present. Preferably such EtO content will be 3 to 10 moles and more preferably it will be 6 to 7 moles, e.g., 6.5 or 7 moles per mole of higher fatty alcohol (and per mole of nonionic detergent). As with the higher fatty alcohol, the polyethoxylate limits given are also limits on the averages of the numbers of EtO groups present in the condensation product. Examples of suitable nonionic detergents include those sold by Shell Chemical Company under the trademark NEODOL™, including NEODOL™ 25-7, NEODOL™ 23-6.5 and NEODOL™ 25-3.

Other useful nonionic detergent compounds include the alkylpolyglycoside and alkylpolysaccharide surfactants, which are well known and extensively described in the art.

The detergent composition may contain a linear alkyl benzene sulfonate anionic surfactant wherein the alkyl radical contains from about 10 to 16 carbon atoms in a straight or branched chain and preferably 12 to 15 carbon atoms. Examples of suitable synthetic anionic surfactants are sodium and potassium alkyl ($C_4$-$C_{20}$) benzene sulfonates, particularly sodium linear secondary alkyl ($C_{10}$-$C_{15}$) benzene sulfonates.

Other suitable anionic detergents which are optionally included in the present liquid detergent compositions are the sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about ⅕ to ½ the number of carbon atoms in R) and M is a solubilizing salt-forming cation, such as an alkali metal, ammonium, or a higher alkyl benzene sulfonate wherein the higher alkyl is of 10 to 15 carbon atoms. The proportion of ethylene oxide in the polyethoxylated higher alkanol sulfate is generally from 1 to 11 ethylene oxide groups and preferably 2 to 5 moles of ethylene oxide groups per mole of anionic detergent, with three moles being most preferred, especially when the higher alkanol is of 11 to 15 carbon atoms.

The most highly preferred water-soluble anionic detergent compounds are the ammonium and substituted ammonium (such as mono, di and tri ethanolamine), alkali metal (such as, sodium and potassium) and alkaline earth metal (such as, calcium and magnesium) salts of the higher alkyl benzene sulfonates, and higher alkyl sulfates.

Builder materials are essential components of the liquid detergent compositions of the present invention. In particular, from about 2% to about 15% of an alkali metal carbonate, such as sodium carbonate, and preferably from about 3% to about 10%, by weight.

A phosphate builder, and in particular an alkali metal (sodium) polyphosphate in an amount of from about 5% to about 30%, by weight, is an integral component of the present liquid detergent compositions. The amount of such polyphosphate builder is preferably from about 8% to about 20%.

Examples of suitable phosphorous-containing inorganic detergency builders include the water-soluble salts, especially alkali metalpyrophosphates, orthophosphates, and polyphosphates. Specific examples of inorganic phosphate builders include sodium and potassium tripolyphosphates, phosphates and hexametaphosphates.

Zeolite A-type aluminosilicate builder, usually hydrated, may optionally be included in the compositions of the invention. Hydrated zeolites X and Y may be useful too, as may be naturally occurring zeolites that can act as detergent builders. Of the various zeolite A products, zeolite 4A, a type of zeolite molecule wherein the pore size is about 4 Angstroms, is often preferred. This type of zeolite is well known in the art and methods for its manufacture are described in the art such as in U.S. Pat. No. 3,114,603.

The zeolite builders are generally of the formula $$(Na_2O)_x \cdot (Al_2O_3)_y \cdot (SiO_2)_z \cdot w\ H_2O$$

wherein x is 1, y is from 0.8 to 1.2, preferably about 1, z is from 1.5 to 3.5, preferably 2 or 3 or about 2, and w is from 0 to 9, preferably 2.5 to 6. The crystalline types of zeolite which may be employed herein include those described in "Zeolite Molecular Series" by Donald Breck, published in 1974 by John Wiley & Sons, typical commercially available zeolites being listed in Table 9.6 at pages 747-749 of the text, such Table being incorporated herein by reference.

The zeolite builder should be a univalent cation exchanging zeolite, i.e., it should be aluminosilicate of a univalent cation such as sodium, potassium, lithium (when practicable) or other alkali metal. or ammonium. A zeolite having an alkali metal cation, especially sodium, is most preferred, as is indicated in the formula shown above. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eg./g., on an anhydrous zeolite basis. A preferred amount of zeolite is from about 8% to about 20%

Other components may be present in the detergent compositions to improve the properties and in some cases, to act as diluents or fillers. Illustrative of suitable adjuvants are enzymes to further promote cleaning of certain hard to remove stains from laundry or hard surfaces. Among enzymes, the proteolytic and amylolytic enzymes are most useful. Other useful adjuvants are foaming agents, such as lauric myristic diethanolamide, when foam is desired, and anti-foams, when desired, such as dimethyl silicone fluids. Also useful are polymers, anti-redeposition agents, bleaches, fluorescent brighteners, such as stilbene brighteners, colorants such as dyes and pigments and perfume.

Analytical Methods

Heated SPME Head Space Analysis of Dry Fabric

Solid phase microextraction (SPME; Almirall, J. R.; Furton, K. G. In Solid Phase Microextraction: A Practical Guide; Scheppers-Wercinski, S., Ed; Marcel Dekker; New York, 1999, pp. 203-216) is a solventless extraction technique through which analytes are extracted from a matrix (such as fabric) into a polymer or other phase, coated on a fused silica fiber. The SPME is coupled with gas chromatography (GC) for desorption and analyses of the analytes.

Materials:

1. Gas Chromatograph with Ion Trap Mass Spec detection and SPME 0.75 mm ID inlet liner. (Varian GC3800/Saturn 2000 equipped with Combi Pal Auto Sampler
2. GC column: CP-SIL-8CB-MS, 30 m×0.25 mm×0.25 μm.
3. SPME Fiber: 100 micro meter polydimethylsiloxane (Supelco 57300-U (manual) or 57301 (automated)).
4. 10 mL Head Space Vials with crimp top and Septa Varian MLA201000 and MLA200051ML Method:

1. Using clean dry scissors, cut (3) 1 gram swatches (2 g for malodor) from the terry cotton towel to be analyzed.
2. Using a glass rod insert each swatch into a 10 mL head space vial, being careful to insert far enough to not damage SPME fiber.
3. Cap vials and allow to equilibrate at room temperature for at least 24 hours.
4. Equilibrate vials at 50° C. for at least 30 minutes in AutoSampler.
5. Insert fiber and expose for 25 minutes at 50° C.
6. Inject into Gas chromatograph and desorb for 30 minutes at 250° C.

GC Conditions:

Injector Temperature: 250° C.

Column Flow: 1 mL/min

Column Oven:

| Temp (° C.) | Rate (C/min) | Hold (min) |
|---|---|---|
| 50 | 0 | 5 |
| 200 | 5 | 5 |
| 220 | 5 | 1 |

Total run time: 45 minutes

Stripping Procedure for Terry Towels

For all sample evaluations 24 new hand Terry towels (86% Cotton, 14% Polyester) were prepared in a 17 gallon top loading washing machine set for hot wash (120° F.), with extra large setting, in tap water. Two wash cycles with 100 g fragrance free Mexican Viva 2 powder detergent, one wash with water only, extra rinse switch was on, was used for all washes. After all three wash cycles were over, the towels were dryer dried in an electric clothes dryer, and laid flat for storage. All fabric ballast used for the tests was processed the same way as towels between each use.

TABLE 1

Detergent Base, B1:

| Ingredient Name | % Weight |
|---|---|
| Water | 6 |
| Sodium $C_9$-$C_{14}$ Linear Alkyl Benzene Sulfonate | 17.3 |
| Sodium Silicate | 7 |
| Silicone Antifoam 1430 (Dow Corning) | 0.01 |
| Pentasodium tripolyphosphate | 36.8 |
| Sodium Sulfate | 36.8 |
| Enzyme Savinase 12T (Novo) | 0.29 |
| Sodium Polyacrylate | 0.9 |
| Alcosperse 412 | |
| Sodium carbonate | 12 |
| Minors | Balance to 100 |

Starch Granules

The Starch/AA. granules were prepared employing CAPSUL™ starch (commercial product from National Starch). CAPSUL™ starch is a dextrinized waxy maize starch octenyl succinate. The dextrinization process to degrade the starch is what differentiates the CAPSUL™ starch from other types of starches Following procedure was used to prepare Starch/AA granules: Pre-blend 33% CAPSUL™ starch in water, at least a day ahead of time using a GREERCO Model No. 1 L mixer. Allow the air to settle out. Take the required amount from this and add fragrance oil and melted amidoamine mixture and homogenize using a Silverson Model L4R mixer. Pour this mixture into the Armfield FT80 Tall Form Spray Dryer and spray dry at 190° C. with 0.5 to 1.0 bar atomizing pressure.

The composition of starch granules (amounts shown are the weight percentages) is as follows (Table 2) used to prepare compositions shown in Table 4:

TABLE 2

Composition of starch granules.

| | Starch/AA |
|---|---|
| Fragrance* | 35 |
| Starch | 56.8 |
| AA | 5.0 |
| Water | Balance to 100 |

*DINASTY ™ substantive fragrance from International Flavors and Fragrances Inc containing the following ingredients:

| | Concentration Wt % | Clog P |
|---|---|---|
| Cyclaprop | 6.7 | 3.51 |
| Nerolin | 2.2 | 3.77 |
| Lilial | 2.1 | 4.1 |
| Isocyclemone E | 11.1 | 5.23 |
| Hexyl Cinnamic Aldehyde | 44.5 | 4.90 |
| Galaxolide | 33.4 | 5.83 |

Surface Oil Content of the Granules Starch/AA and the Performance Comparison with Starch/Silica.

A study indicates that the hydrophobic additive AA significantly reduces the amount of perfume (DINASTY™ substantive fragrance) at the surface of the dried starch capsules from 2.89% (no AA) to 0.24% (Table 3). In contrast to AA, another study reveals that a hydrophobically modified silica (AEROSIL™ R974; preferred additive of prior art, patent application WO 01/05926) does not reduce the amount of surface oil to the same extent as does the amidoamine (Table 3). The AEROSIL™ reduces the amount of surface oil (DINASTY™ perfume) at the starch granule from 3.09% (no AEROSIL™) to 2.38% (with AEROSIL™). Surface oil was measured by extraction of the encapsulated particle with hexane at room temperature and atmospheric pressure, followed by gas chromatography. The hexane extracts only the fragrance oil on the surface of the particle, not the oil encapsulated within the particle.

TABLE 3

The amounts of surface oil (only substantive fraction) at the starch fragrance granule.

| | Surface Oil (wt %) | Surface Oil (wt %) |
|---|---|---|
| Starch* | 3.09 | 2.89 |
| Starch/AA** | | 0.24 |
| Starch/AEROSIL ™ R974*** | 2.38 | |

*Granule consists of [CAPSUL ™ starch (65%), DINASTY ™ Substantive Fragrance (35%)]
**Granule consists of [CAPSUL ™ starch (60%), Difatty Amidoamine (5%), DINASTY ™ Substantive Fragrance (35%)]
***Granule consists of [CAPSUL ™ starch (64.29%), AEROSIL ™ R974 (0.71%), DINASTY ™ Substantive Fragrance (35%)]

TABLE 4

Compositions 1 and 2

| | | 1 (Control) Weight % | 2 (Starch/AA) Weight % |
|---|---|---|---|
| B1 | Base Bead | 97.6 | 97.6 |
| | Fragrance* | 0.31 | 0.31 |
| | Starch/AA** | — | 1.23* |

TABLE 4-continued

Compositions 1 and 2

| | | 1 (Control) Weight % | 2 (Starch/AA) Weight % |
|---|---|---|---|
| | Fragrance Granule | | |
| | DINASTY ™*** substantive fraction | 0.43 | |
| | Deionized water | to 100 | to 100 |

*Fragrance post added to B1 Base Bead
**The granules contained 35% DINASTY ™ substantive fragrance (or 0.43% in the formula) (Table 2)
***Fragrance composition shown (Table 2)

The above formulas were used under the following conditions:

Temperature is 77° F., water Hardness is 50 ppm, 10 minutes wash, 5 minutes rinse, washers are Maytag machines, 3 wash cycle.

Fabric load is 12 terry cotton swatches (10×10 inches). Swatches are prewashed to strip before using. After wash, swatches are line dried for 1 and 7 days.

Detergent concentration is 78 gm.

Washing is done by filling the washing machines with water then adding water hardness at 50 ppm by adding a stock solution of 250,000 ppm water. Add product and agitate for 1 minute.

Add swatches, wash for 10 minutes and rinse for 5 minutes.

Add swatches, wash for 10 minutes and rinse for 5 minutes.

After wash is finished, line dry swatches for 1 and 7 days and cut samples of fabrics for SPME analysis (1 gm of fabric/SPME vial, 4 Vials/Product).

TABLE 5

Total fragrance counts on the dried fabric surface (after day-7) as observed by Solid Phase Microextraction Method.

| | |
|---|---|
| Control | 3090065 |
| Starch/AA | 4670633 |

As shown in Table 5, the use of fragrance granules (composition 2, Table 4) deposits relatively more fragrance onto the fabric surface as compared to a control (composition 1, Table 4).

What is claimed is:

1. An oil containing starch granule comprising:

(a) a starch, said starch being present in an amount to form an effective matrix for said granule;

(b) a perfume oil comprising ingredients having a calculated Clog P of at least 3, said Clog P being the calculated octanol to water partition coefficient, said perfume oil being capable of providing a benefit-additive to a substrate upon contact therewith; and (c) an effective amount of an organic compound comprising a quaternary ammonium compound for inhibiting the migration of said oil to the surface of said starch granule, said compound being represented by the following structure:

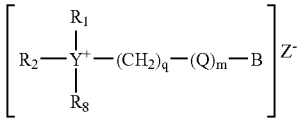

wherein $R_1$ and $R_2$ are each independently, H or:

(a) $C_1$-$C_{22}$ alkylenecarboxy moiety having the formula:

$$—(CH_2)_eR_3$$

wherein $R_3$ is $—NHCOR_4$; or $—OCOR_4$; or $—NR_5COR_4$; and wherein $R_4$ and $R_5$ are each independently $C_1$-$C_{22}$ akyl or alkenyl; and e is an integer from 1 to 22; or (b) $C_1$-$C_{22}$ linear or branched alkyl; or (c) $C_1$-$C_{22}$ linear or branched alkenyl; or (d) $C_2$-$C_{22}$ substituted or unsubstituted alkylenoxy; or (e) $C_3$-$C_{22}$ substituted or unsubstituted alkylenoxy alkyl; or (f) $C_6$-$C_{22}$ substituted or unsubstituted aryloxy; or (g) $C_7$-$C_{22}$ substituted or unsubstituted alkylenearyl; or (h) $C_7$-$C_{22}$ substituted or unsubstituted alkyleneoxyaryl; or (i) $C_7$-$C_{22}$ oxyalkylenearyl; or (j)an anionic unit having the formula:

$$—(CH_2)_yR_6$$

wherein $R_6$ is $—SO_3M$, $—OSO_3M$, $—PO_3M$, $—OPO_3M$, Cl or mixtures thereof, wherein M is hydrogen, or one or more salt forming cations sufficient to satisfy charge balance, or mixtures thereof;

y is an integer from 1 to about 22; and (k) a mixture comprising at least two of (a) through (j); and q is an integer from 0 to about 22;

m is an integer from 0 to about 22;

Q is $(CH_2)_m$ or $(CH_2CHR_7O)$;

$R_7$ is independently hydrogen, methyl, ethyl, propyl or benzyl; and mixtures thereof;

B is H or OH;

Y is N;

$R_8$ is H or $C_1$-$C_4$ alkyl;

$Z^-$ is a counter anion.

2. A method of preparing the oil containing starch granule of claim 1 comprising the steps of:

(a) providing a dispersion of starch in water to form a starch slurry;

(b) melting an effective amount of the organic compound to form an organic compound melt;

(c) adding the perfume oil to the organic compound melt of step (b) to form a solution of organic compound in perfume oil;

(d) adding the solution of step (c) to the starch slurry of step (a);

(e) homogenizing the resultant slurry by mixing to form a uniform homogeneous mixture; and (f) spray-drying said homogeneous mixture to form the oil containing starch granule.

3. A method of laundering fabrics comprising the steps of (a) forming an aqueous solution containing an effective amount of the oil containing starch granule of claim 1; and (b) contacting the fabrics to be laundered with the aqueous solution of (a).

4. A laundry detergent composition comprising:

(a) at least one surf actant; and (b) an effective amount of the oil containing starch granule of claim 1.

* * * * *